US006401412B1

(12) United States Patent
Cooper

(10) Patent No.: US 6,401,412 B1
(45) Date of Patent: Jun. 11, 2002

(54) METAL ROOF SYSTEM

(76) Inventor: John Cooper, P.O. Box 8053, Squaw Valley, CA (US) 93308

( * ) Notice: Subject to any disclaimer, the term of this patent is extended or adjusted under 35 U.S.C. 154(b) by 0 days.

(21) Appl. No.: 09/546,598

(22) Filed: Apr. 10, 2000

(51) Int. Cl.[7] ..... E04B 1/70; E04F 17/00; E04F 17/04; E04F 17/08

(52) U.S. Cl. ..... 52/302.1; 52/198; 52/336; 52/302.2; 52/302.3; 52/310; 52/90.1; 52/537; 52/730.6; 52/302.6; 52/506.06; 52/508; 52/90.2

(58) Field of Search ..... 52/302.1, 198.336, 52/302.2, 302.3, 310, 90.1, 537, 730.6, 302.6, 506.06, 508, 90.2

(56) References Cited

U.S. PATENT DOCUMENTS 3,094,197 A * 6/1963 Attwood ..... 52/302.6
5,367,848 A * 11/1994 McConnhie ..... 52/336
5,561,953 A 10/1996 Rotter
5,660,004 A 8/1997 Blackmon et al.
5,765,329 A 6/1998 Huang
5,826,383 A 10/1998 Garrison
5,875,592 A 3/1999 Allman
6,079,166 A * 6/2000 Mason et al. ..... 52/198

* cited by examiner

*Primary Examiner*—Beth A. Stephan
*Assistant Examiner*—Chi Q. Nguyen
(74) *Attorney, Agent, or Firm*—Richard A. Ryan

(57) ABSTRACT

A roof system for sloped metal roofs utilizing plywood decking, corrugated metal panels and one or more spacers disposed between the decking and metal panels for holding the metal panels vertically above the decking. The spacers have a planar top section, a planar bottom section and a center section to hold the top and bottom sections in spaced apart relation. The spacers also have one or more openings to form an airflow cavity between the decking and metal panels to permit the circulation of air therein. In the preferred embodiment, a thermal barrier layer is disposed between the spacers and the decking and the airflow cavity connects to a ridge vent located at the ridge of the roof and an eave vent at the eave of the roof. The roof system allows ambient air to be drawn into the eave vent to circulate through the airflow cavity and out the ridge vent in order to prevent thermal flexing of the metal roof and the build-up of moisture between the metal panels and decking.

20 Claims, 3 Drawing Sheets

METAL ROOF SYSTEM

BACKGROUND OF THE INVENTION

1. Field of the Invention

The field of the present invention relates generally to metal roof systems. More particularly, the present invention relates to metal roof systems that facilitate air circulation from the eave to the ridge between roof layers to improve the useful life and operation of the roof.

2. Background

Many structures utilize metal roof systems to protect the interior of the structure from exposure to the elements, including sun, rain, snow and the like. Metal roofs are utilized on metal, brick, wood and other structures. Generally, the structure is built with interior columns that support a series of rafters or beams attached at the top of the columns. The roof rafters or beams are typically attached in a sloped manner with a ridge at the top to provide positive downward drainage. Spanning the rafters or beams are a series of light gauge metal Z-shaped or C-shaped structural members commonly referred to as purlins. The purlins generally run perpendicular to the rafters or beams and are configured to be in a spaced apart relationship to each other provide structural support for the overlying metal roof system.

One well known and commonly utilized metal roof system for sloped roofs comprises a decking attached to the purlins and a plurality of metal panels attached to the decking with a thermal barrier disposed between the decking and metal panels. The decking material is attached with screws or bolts directly to the purlins that are attached to the roof rafters or beams. Most often, but not exclusively, the decking consists of a plurality of wooden panels, such as plywood, spaced side-by-side on top of the purlins. In many areas of the United States, the thermal and waterproof barrier is placed over the decking material to resist the flow of water, either from rain or snow, into the structure and to provide some degree of insulating effect for the interior of the structure. One common type of thermal barrier comprises roofing (i.e, felt) paper with a plastic covering over the roofing paper. The uppermost part of the roof, the metal panels, are attached to the decking on top of the thermal barrier. A very common type of metal panel utilized for metal roofs is the corrogated steel sheet having a plurality of spaced apart and parallel, alternating ribs and valleys. Although the rib configuration (i.e., the shape and size) varies considerably among the many manufacturers of corrugated panels, the valleys are generally flat to form a lower plane that is spaced apart from the top of the ribs. Threaded screws are typically used to attach the metal panels to the underlying decking.

The above-described roofing system is generally sufficient to obtain a relatively strong, lightweight and weather resistant roof to protect the interior and building components of a structure. A common and well known problem with all metal roofs results from the high thermal conductivity of the metal material used for roofing. During cold weather or when snow is on the roof, the metal roof components will contract. When there is sunshine, even during cold days, the sun will heat up the upper metal panels and the air trapped between the metal panels and the decking. The heretofore standard configuration for metal roofs results in thermal expansion and contraction (i.e., thermal flexing) of the roof in response to temperature changes during the day and through the seasons. In areas of the United States where colder temperatures and/or snow conditions are common in the winter months, the thermal flexing of the roofing material is even more pronounced (particularly on the side of the roof that faces the sun). One well known result of this thermal flexing is that the threaded metal screws will back partially or completely out from the decking to which they were attached. The heating and cooling of the interior of the structure exsasberates this problem by creating back pressure that helps work the screw out. In addition to the obvious problem of reducing the structural integrity of the roof system, the backing out of the screws creates a conduit for moisture to enter into the space between the metal panels and the decking. Once moisture enters this area, it begins to result in the rotting of the thermal barrier and then the underlying decking, thereby damaging the roof and necessitating expensive repairs and/or retrofitting of the roof. Even without the backing out problem, moisture can build-up in between the metal panels and the decking due to the "sweating" of the metal panels from the temperature fluctuations of the air trapped therein.

Although the above problem is well known, there are no known solutions that effectively address and prevent the backing out of the screws and the moisture build-up in between the metal panels and decking. One way to reduce the thermal flexing problem and the sweating action is to lessen the amount of temperature changes that affect the roof system. As set forth in the present invention, this can be done utilizing air circulation and the principles of air convection to reduce the thermal flexing effect and maintain the space between the metal panels and the decking in a dry condition to reduce or prevent damage to the roof. Currently there are no known systems for accomplishing this objective.

Builders of structures having metal roofs have long known of the benefits of installing a vent along the roof ridge to vent out air from the attic or interior of the structure. Early vents were as simple as an open slot running along the entire length of the ridge. Later vents were developed to allow air to escape but prevent moisture and other elements from entering the interior of the structure. The ridge vents allow air to vent from the structure by convection airflow and by suction from wind blowing across the roof. Air vents added to the eave (or soffit) of the structure improved airflow by providing passive ventilation through the introduction of fresh ambient air into the attic or interior. As stale, hot air is withdrawn from the structure by convection and/or wind suction at the ridge vent, fresh ambient air is drawn into the attic or structure at the eave vent.

Other inventors have developed a variety of systems for the convection of air from structures having metal roofs. For instance, U.S. Pat. No. 5,765,329 to Huang describes roof venting system for metal roofs using two sets of corrugated metal sheets with spacers between the sheets to vent hot air to the atmosphere through a plurality of apertures in the corrugated sheets for improved heat radiation, heat insulation and the withdrawal of gasses from the interior space of the building. U.S. Pat. No. 5,826,383 to Garrison describes a roof venting system that utilizes ridge venting and eave venting to vent hot air from the interior of the building while preventing water, debris and pests from entering the interior of the building. U.S. Pat. No. 5,561,953 to Rotter describes a roof ridge ventilation system for metal roofs to allow vapors inside the building to vent out through an air permeable, resilient member located at the roof ridge. U.S. Pat. No. 5,367,848 to McConnohie describes a bracket for use to attach a new metal roof over the ribbed panels of an existing corrugated metal roof.

The above-described patents demonstrate that it is well known to ventilate structures having sloped roofs by utilizing vents at the top ridge of the roof and/or at the eave of the roof. These patents generally describe various roof systems for ventilating the interior of the structure through the roof itself or through ridge or eave vents attached thereto. However, none of the related art describe, singularly or in combination, a simple, easy to install system to improve air circulation between the metal roof panels and the decking to reduce the amount of thermal flexing in order to prevent the well known problem of the metal screws backing out. Consequently, a need exists for a metal roof system that is inexpensive to manufacture and easy to install, yet which induces air circulation between the metal roof panels and the decking to prevent the backing out of screws due to thermal flexing.

SUMMARY OF THE INVENTION

The metal roof system of the present invention provides the benefits and solves the problems identified above. That is to say, the present invention provides a metal roof system that is inexpensive to manufacture and easy to install to reduce or eliminate the likelihood of the screws backing out of the metal roof panels and creating conduits for the entry of moisture into the roof system. In addition to the above benefits, the present invention increases the circulation of air to improve insulation and reduce moisture migration.

The present invention is directed to a structure having a sloped metal roof with a first end and a second end thereon, such that the roof slopes in a generally downward direction from the roof ridge at the first end to the eave at the second end. The metal roof system of the present invention comprises a lower decking layer, an upper metal panel layer and a spacer disposed between the decking and metal panels. In certain parts of the United States it is advantageous to include a thermal barrier layer between the decking and the spacers to further protect the decking. The decking is generally attached to the roof rafters, or to purlins attached to the roof rafters, with the use of screws and the like, as are suitable for securely fastening the decking to the structure. Typically, the decking is made from a plurality of plywood panels laid side-by-side across the entire roof of the structure. The metal panels can comprise a plurality of corrugated metal sheets joined together side-by-side across the roof and attached to the spacers on the decking utilizing metal screws or other fastening devices for securely fastening the metal panels to the spacer. The typical metal panel has a series of spaced apart, alternating ribs and valleys, with the valleys being generally flat to form a planar bottom. The metal panels are joined to the spacers at the flat valleys.

In the preferred embodiment of the present invention, the spacer comprises a shaped member configured to have a generally planar top section to abut the planar surface formed by the flat valleys of the metal panels, a generally flat bottom section to abut the planar surface of the decking and a center section that vertically disposes the top and bottom sections in a spaced apart relationship. The bottom section of the spacer attaches to the decking or the rafters or purlins under the decking using the appropriate wood or metal screws. The metal panels attach to the top section of the spacer at the flat valley portions of the metal panels using metal screws or the like. The center section includes one or more openings therein to form an airflow cavity between the decking and the metal panels. In the preferred embodiment, the center section has a plurality of openings sized and configured so as to not substantially reduce the strength and carrying capability of the spacer.

The preferred embodiment of the metal roof system of the present invention also includes a ridge vent at the first end of the metal roof. The ridge vent should be configured to be in fluid flow communication with the airflow cavity created by the spacers between the metal panels and the decking so as to allow hot, stale air to be withdrawn through the ridge vent by convection airflow and/or wind suction across the roof ridge. Preferably, the metal roof system also includes an eave vent disposed at the second end of the metal roof. The eave vent should also be in fluid flow communication with the airflow cavity so as to facilitate passive ventilation through the introduction of fresh ambient air into the airflow cavity and out the ridge vent. In this manner, the effects of changing temperature will have less impact on the metal roof system and will reduce or eliminate the thermal flexing that results in the backing out of the screws that fasten the metal panels to the spacer. Because the screws or other fasteners will remain in place, conduits for the transfer of moisture from the exterior to the interior of the roof will not form and result in rotting of the thermal barrier or decking underneath the metal panels. In addition, the circulation of air between the metal panels and the decking will eliminate or reduce the sweating effect that can also result in moisture build-up.

Accordingly, the primary objective of the present invention is to provide a metal roof system which can be inexpensively made and easily installed on metal roofs to improve the useful life of the roof and reduce roof repair and/or replacement costs.

It is also an important objective of the present invention to provide a metal roof system that utilizes a spacer, having one or more openings therein, disposed between the metal panels and the underlying decking to form an airflow cavity for the circulation of air between the decking and metal panels.

It is also an important objective of the present invention to provide a metal roof system that connects an airflow cavity created between the metal panels and underlying decking to air vents located at the roof ridge and eaves to allow ambient air to be drawn in at the eave vent and circulated through the airflow cavity and out the ridge vent to the atmosphere in order to reduce or eliminate thermal flexing that can result in the creation of conduits from the backing out of screws.

It is also an important objective of the present invention to provide a metal roof system that utilizes a spacer having generally flat top section, a generally flat bottom section and a center section, having one or more openings disposed therein, that interconnects the top and bottom sections in a spaced apart relation.

The above and other objectives of the present invention will be explained in greater detail by reference to the attached figures and the description of the preferred embodiment which follows. As set forth herein, the present invention resides in the novel features of form, construction, mode of operation and combination of parts presently described and understood by the claims.

BRIEF DESCRIPTION OF THE DRAWINGS

In the drawings which illustrate the best modes presently contemplated for carrying out the present invention.

DETAILED DESCRIPTION OF THE PREFERRED EMBODIMENTS

Figure 1:
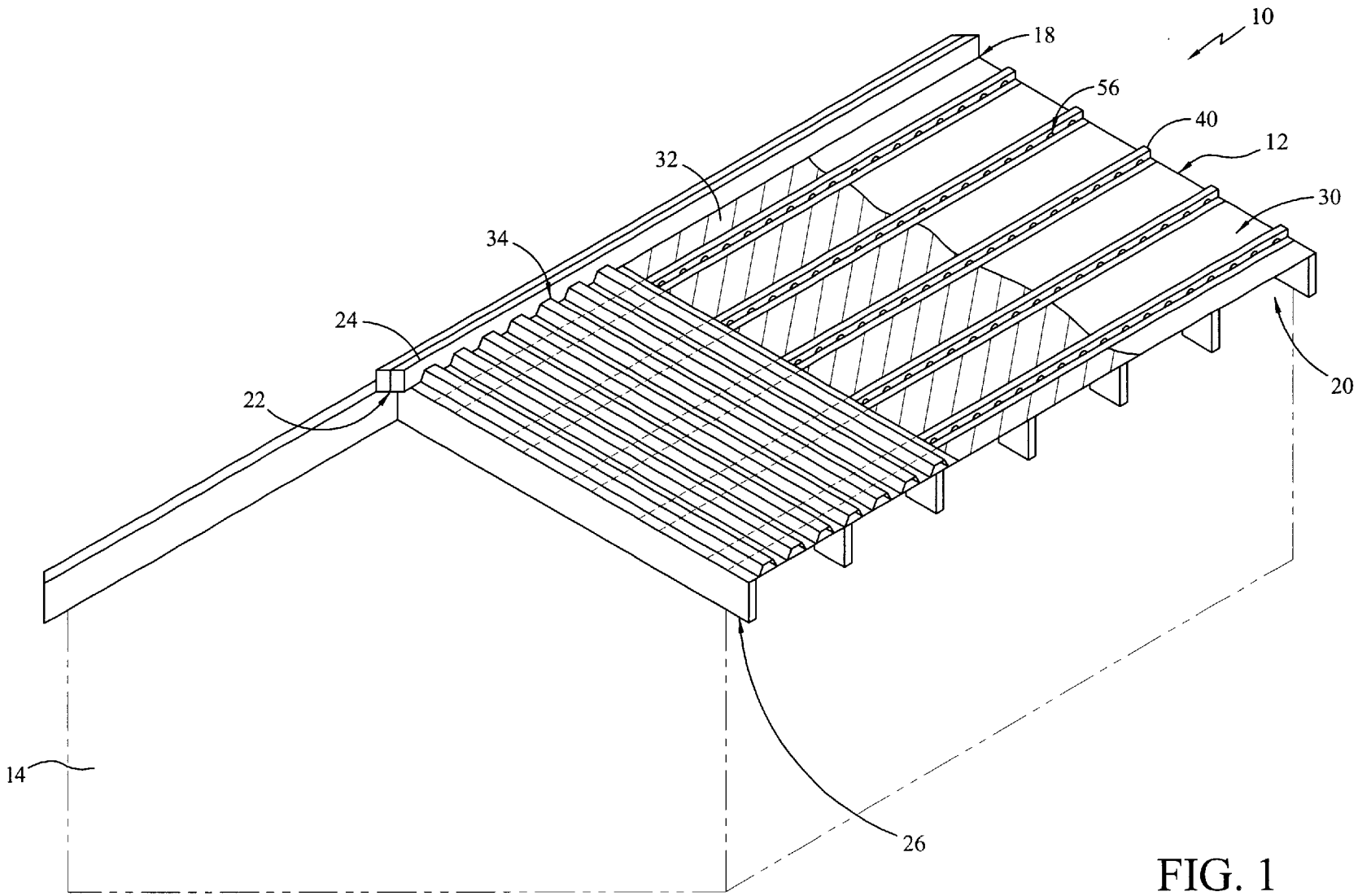
FIG. 1 is a perspective view of a structure utilizing the metal roof system of the present invention.
Figure 2:
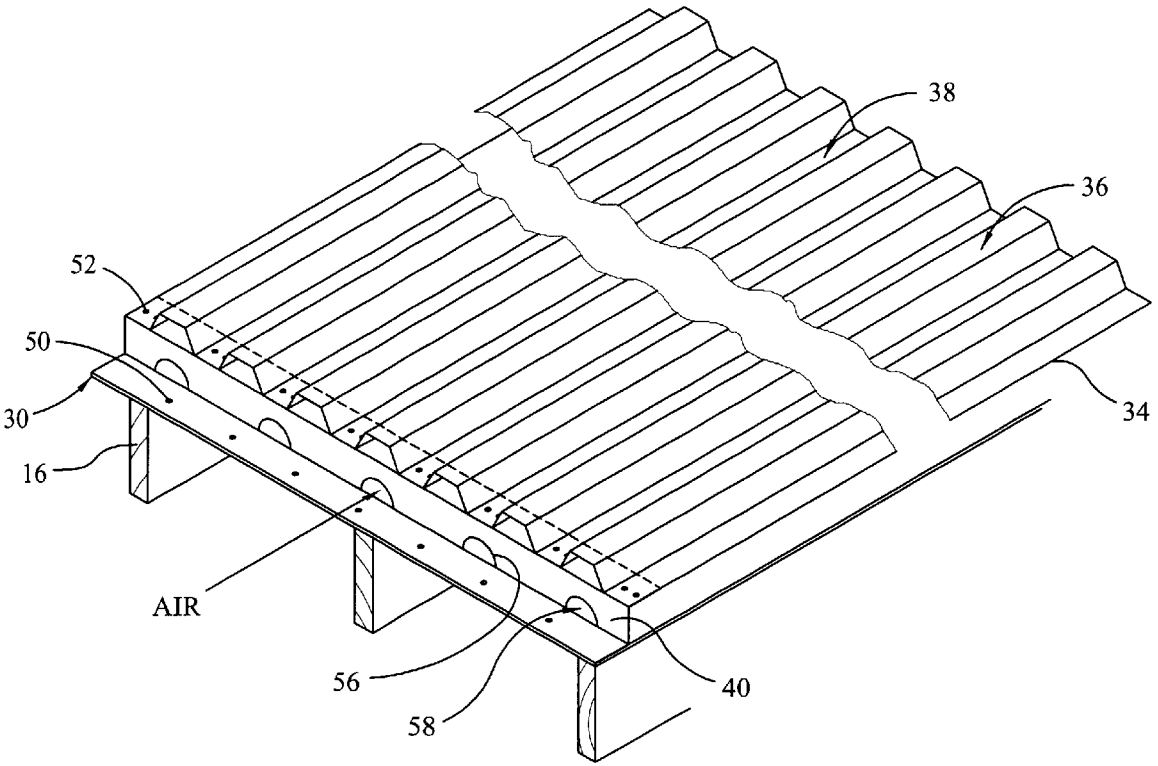
FIG. 2 is a side perspective view of the present invention.
Figure 3:
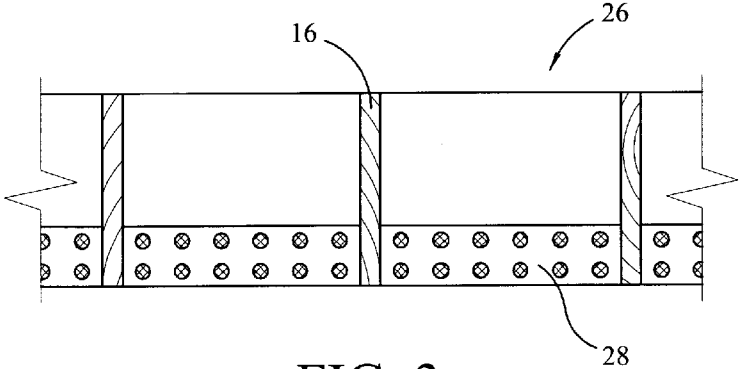
FIG. 3 is a bottom view of the eave vent used with the present invention.

With reference to the figures where like elements have been given like numerical designations to facilitate the reader's understanding of the present invention, and particularly with reference to the embodiment of the present invention illustrated in FIGS. 1 through 4, the preferred embodiment of the present invention is set forth below. The metal roof system of the present invention, shown generally as 10, can be utilized as a roof 12 for structure 14 having rafters 16, as illustrated in FIGS. 1 and 2. As exemplified in FIG. 1, roof 12 slopes in a generally downward direction from first end 18 to second end 20 thereof. At first end 18 of roof 12 is roof ridge 22 having a ridge vent 24, shown in FIG. 1, that vents to the atmosphere. At second end 20 is the eave 26 of structure 14, having eave vent 28, as shown in FIG. 3, which is also open to the atmosphere.

The typical metal roof 12 has decking 30 that is attached directly to rafters 16 or to purlins (not shown) that connect to the rafters 16. The typical decking 30 comprises a plurality of four by eight foot plywood sheets that are laid side-by-side across the top of structure 14. The plywood decking 30 is fixedly attached to the structure 14 using nails, screws or other fastening devices well known in the relevant art to provide a secure base for the remaining roof materials. Although not required, the typical metal roof system 10 also utilizes one or more layers of a thermal barrier 32 on top of decking 30 to provide weather proofing and insulating benefits to structure 14. The typical thermal barrier 32 is roofing paper made out of a felt material. If desired, additional weather proofing and insulating benefits can be obtained by including a layer of plastic material, such as six mil plastic, with the thermal barrier. On top of the thermal barrier 32 are attached one or more metal panels 34. Typically, a series of metal panels 34 are used to cover the entire roof 12. The typical metal panel 34 is a corrugated metal panel having a plurality of spaced apart and parallel, alternating ribs 36 and valleys 38. Although the rib 36 configuration can vary depending on the manufacturer, the ribs 36 are generally such that the tops of rib 36 is vertically disposed from the valley 38. To facilitate attachment of metal panels 34 to the decking 30, the individual valleys 38 are generally flat to form a level, planar lower surface of metal panels 34. Metal panels 34 are typically attached to decking 30 using threaded screws or the like through the flat valley 38 portion of metal panels 34. As discussed herein, these screws have a common and well known tendency to back partially or completely out and create a conduit for the introduction of moisture into the area between metal panels 34 and decking 30. This moisture can rot out the thermal barrier 32 and, over time, the decking 30 itself. This action can severely damage a roof system and require expensive repairs and/or retrofitting of the roof 12.

Figure 4:
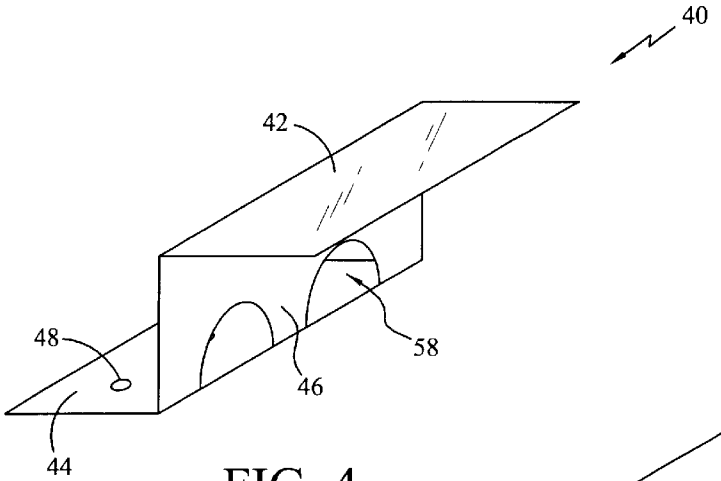
FIG. 4 is a perspective view of the preferred spacer to be used with the present invention.
Figure 5:
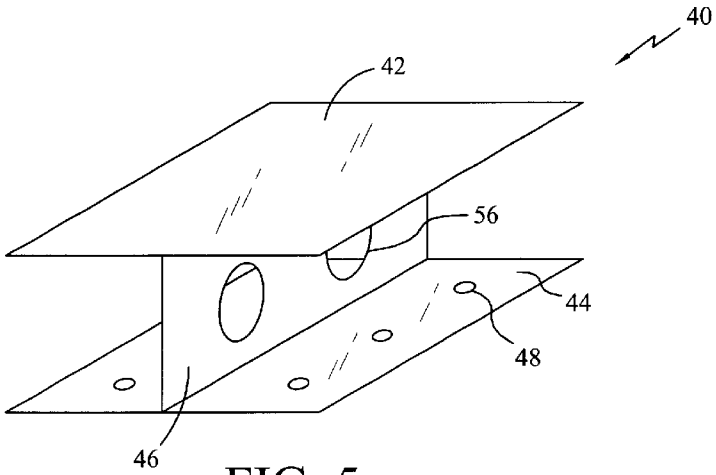
FIG. 5 is a perspective view of an alternative spacer that can be used with the present invention.
Figure 6:
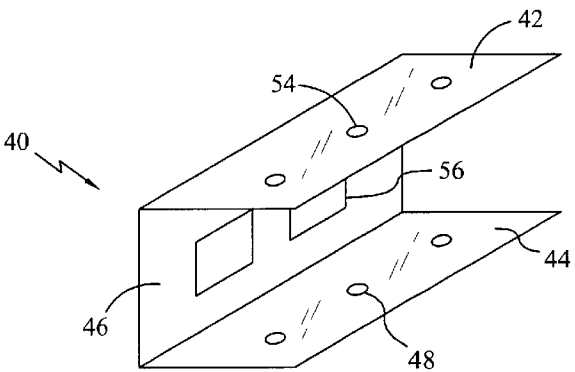
FIG. 6 is a perspective view of an alternative spacer that can be used with the present invention.

The metal roof system 10 of the present invention solves the aforementioned problem of screws backing out and conduit creation by utilizing a spacer 40 disposed between the metal panels 34 and decking 30 (or if a thermal barrier 32 is utilized, between metal panels 34 and thermal barrier 32). In the preferred embodiment, shown in FIG. 4, spacer 40 is a generally Z-shaped member having a planar top portion 42, a planar bottom portion 44 and a center portion 46 therebetween to maintain the top portion 42 and bottom portion 46 in a generally vertically spaced apart relation. Spacer 40 can be made out of metal, such as sixteen gauge metal or the same metal used for metal panels 34, or other materials suitable for maintaining the separation of metal panels 34 and decking 30. Bottom portion 44 can have one or more holes 48 therein, as shown in FIGS. 4 through 6, to facilitate connection of spacer 40 to decking 30 during installation of metal roof system 10. Fastener 50, such as wood screws or the like, can be used to attach spacer 40 to decking 30 through thermal barrier 32 (if used). Typically, metal screws 52 or other appropriate fasteners, will be used to attach metal panels 34 to top portion 42 of spacer 40. Screws 52 can be the self-tapping type having a neoprene washer with a drill bit-type point such that they can be screwed directly into spacer 40. Alternatively, as shown in FIG. 6, spacer 40 can include one or more holes 54 in top portion 42 for receiving screws 52.

Spacer 40 has one or more openings 56 in spacer 40 to create an airflow cavity 58 between metal panels 34 and decking 30. In the preferred embodiment, spacer 40 has a plurality of openings in spaced apart relation along the length of spacer 40. The size and configuration of openings 56 should be such so as to not substantially reduce the strength of spacer 40 with regard to the anticipated loading from metal panels 34 and any snow or other loads that can be carried by metal panels 34 themselves. In the preferred Z-shaped spacer 40, shown in FIG. 4, openings 56 can be disposed in center section 46 at or near bottom section 44. Although the Z-shaped configuration shown in FIG. 4 has certain manufacturing and installation advantages, spacer 40 can be of a variety of configurations that provide a top portion 42, bottom portion 44 and center portion 46 to accomplish the objectives of the present invention 10, as exemplified in FIGS. 5 and 6.

Airflow cavity 58 formed by spacer 40 between metal panels 34 and decking 30 (or, if used, thermal barrier 32), is in fluid flow connection with ridge vent 24 and eave vent 28 to induce air circulation through airflow cavity 58. Convection airflow and the suction effect of wind blowing past ridge 22 pulls out hot, stale air from between metal panels 34 and decking 30. Passive ventilation from the eave vents circulates fresh ambient air through the airflow cavity 58. The circulation of ambient air reduces or eliminates the likelihood of moisture build-up between the metal panels 34 and decking 30 and reduces the thermal flexing that results from the effect of temperature variations on the metal panels 34. As such, screws 52 which hold metal panels 34 to spacers 34 will not back out and create conduits for rain, snow or other moisture.

For structural support purposes, the preferred embodiment of the present invention 10, as shown in FIG. 1, utilizes a plurality of spacers 40 in spaced apart relation between the first 18 and second 20 ends of roof 12. If desired, spacers 40 can be generally parallel with each other and with roof ridge 22 and/or the edge near eave 26. Alternatively, spaces 40 can be off-set (i.e., at an angle) from being parallel with eave 26 so as to facilitate drainage of any moisture that would happen to collect in airflow cavity 58 between metal panels 34 and decking 30. A drainage opening (not shown) could be included to allow any such moisture to drain out of airflow cavity 58.

In use, the builder of structure 14 would install the metal roof system 10 of the present invention by first attaching the decking 30, such as one or more plywood panels, to the roof structural support members, such as rafters 16 or, if used, the purlins attached to the rafters 16. After the decking 30 is fixedly attached to rafters 16, one or more spaced apart spacers 40 are attached to decking 30 using screws 50 or other appropriate fasteners. If additional waterproofing and insulating benefits are desired, thermal barrier 32 can be placed on decking 30 prior to installation of spacers 40 thereon. One or more metal panels 34 are then installed directly onto spacers 40 by inserting self-tapping screws or other appropriate fasteners through the flat valley 38 into the top portion 42 of spacer 40. For improved air circulation, ridge vent 24 and eave vents 28 should be installed at the roof ridge 22 and eave 26, respectively. The ridge vent 24 and eave vents should be configured to be in fluid flow connection with airflow cavity 58 so ambient air may be induced to enter between metal panels 34 and decking 30 and circulate out through ridge vent 24 to reduce or eliminate the thermal flexing effect and moisture build-up in airflow cavity 58.

While there is shown and described herein certain specific alternative forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to the dimensional relationships set forth herein and modifications in assembly, materials, size, shape and use.

What is claimed is:

1. A metal roof system adapted to allow for ventilation of vapors, comprising:

a sloped roof having a first end and a second end thereof, said roof sloping generally downward from said first end to said second end, said roof having a wooden decking and a metal panel overlaying said decking, said decking having a generally planar top surface, said metal panel having a generally planar portion thereon;

at least one spacer disposed between said decking and said metal panel, said at least one spacer having one or more openings therein to form an airflow cavity between said decking and said metal panel, said airflow cavity adapted for the flow of air between said second end of said roof and said first end of said roof;

a first fastener attaching said spacer to said decking; and a second fastener attaching said metal panels to said spacer.

2. The metal roof system according to claim 1, wherein said spacer has a generally planar top section, a generally planar bottom section and a center section interconnecting said top section and said bottom section, said center section maintaining said top section and said bottom section in a spaced apart relation.

3. The metal roof system according to claim 1 further comprising a ridge vent at said first end of said roof, said ridge vent in fluid flow connection with said airflow cavity.

4. The metal roof system according to claim 1 further comprising an eave vent at said second end of said roof, said eave vent in fluid flow connection with said airflow cavity.

5. The metal roof system according to claim 4 further comprising a ridge vent at said first end of said roof, said ridge vent in fluid flow connection with said airflow cavity and said eave vent.

6. The metal roof system according to claim 1, wherein said metal panels have a plurality of alternating ribs and valleys, said valleys forming said planar portion of said metal panels.

7. The metal roof system according to claim 1, wherein said roof system comprises a plurality of spacers disposed between said first end and said second end of said roof, each of said plurality of spacers in spaced apart relation to each other.

8. The metal roof system according to claim 7, wherein said spacers are installed on said roof in a direction generally transverse to the slope of said roof.

9. The metal roof system according to claim 7, wherein said spacers are installed on said roof in a direction generally offset from said transverse of the slope of said roof.

10. The metal roof system according to claim 1, wherein said decking is made out of wood.

11. The metal roof system according to claim 1, wherein said spacers are generally Z-shaped.

12. A metal roof system adapted to allow for ventilation of vapors, comprising:

a sloped roof having a first end and a second end thereof, said roof sloping generally downward from said first end to said second end, said roof having a wooden decking and a metal panel overlaying said decking, said decking having a generally planar top surface, said metal panel having a generally planar portion thereon;

a plurality of spacers disposed between said decking and said metal panel, each of said spacers having a generally planar top section, a generally planar bottom section and a center section interconnecting said top section and said bottom section, said center section maintaining said top section and said bottom section in a spaced apart relation, one or more openings in said center section of said spacers, said one or more openings forming an airflow cavity between said decking and said metal panel, said airflow cavity adapted for the flow of air between said second end of said roof and said first end of said roof;

a first fastener attaching said spacer to said decking;

a second fastener attaching said metal panels to said spacer; and a ridge vent at said first end of said roof, said ridge vent in fluid flow connection with said airflow cavity.

13. The metal roof system according to claim 12 further comprising an eave vent at said second end of said roof, said eave vent in fluid flow connection with said airflow cavity and said ridge vent.

14. The metal roof system according to claim 12, wherein said spacers are installed on said roof in a direction generally transverse to the slope of said roof.

15. The metal roof system according to claim 12, wherein said spacers are installed on said roof in a direction generally offset from said transverse of the slope of said roof.

16. The metal roof system according to claim 12, wherein said decking is made out of wood.

17. A method of installing a metal roof system adapted to allow for ventilation of vapors on a sloped roof, comprising the steps of:

a) Attaching a wooden decking to a roof support member of a structure;

b) Attaching one or more spacers to said decking, wherein each of said spacers has a generally planar top section, a generally planar bottom section and a center section disposed therebetween, said center section having one or more openings therein; and c) Attaching a metal panel to said top section of said spacers.

18. The method of claim 17, wherein said decking is made out of wood.

19. The method of claim 17 further comprising the step of connecting said metal panel to a ridge vent on said roof.

20. The method of claim 19 further comprising the step of connecting said metal panel to a eave vent on said roof.

* * * * *

US006401412C1

(12) EX PARTE REEXAMINATION CERTIFICATE (8806th)

United States Patent

Cooper

(10) Number: US 6,401,412 C1

(45) Certificate Issued: Jan. 17, 2012

(54) METAL ROOF SYSTEM

(75) Inventor: John Cooper, Squaw Valley, CA (US)

(73) Assignee: Cool Building System, Inc., San Antonio, TX (US)

Reexamination Request:
No. 90/009,720, Jul. 8, 2010

Reexamination Certificate for:

| | |
|---|---|
| Patent No.: | **6,401,412** |
| Issued: | **Jun. 11, 2002** |
| Appl. No.: | **09/546,598** |
| Filed: | **Apr. 10, 2000** |

(51) Int. Cl.

| | |
|---|---|
| ***E04B 1/70*** | (2006.01) |
| ***E04F 17/00*** | (2006.01) |
| ***E04F 17/04*** | (2006.01) |
| ***E04F 17/08*** | (2006.01) |

(52) U.S. Cl. ..... 52/302.1; 52/198; 52/336; 52/302.2; 52/302.3; 52/310; 52/90.1; 52/537; 52/730.6; 52/302.6; 52/506.06; 52/508; 52/90.2; 52/846

(58) Field of Classification Search ..... 52/302
See application file for complete search history.

(56) References Cited

To view the complete listing of prior art documents cited during the proceeding for Reexamination Control Number 90/009,720, please refer to the USPTO's public Patent Application Information Retrieval (PAIR) system under the Display References tab.

*Primary Examiner*—Catherine S. Williams

(57) ABSTRACT

A roof system for sloped metal roofs utilizing plywood decking, corrugated metal panels and one or more spacers disposed between the decking and metal panels for holding the metal panels vertically above the decking. The spacers have a planar top section, a planar bottom section and a center section to hold the top and bottom sections in spaced apart relation. The spacers also have one or more openings to form an airflow cavity between the decking and metal panels to permit the circulation of air therein. In the preferred embodiment, a thermal barrier layer is disposed between the spacers and the decking and the airflow cavity connects to a ridge vent located at the ridge of the roof and an eave vent at the eave of the roof. The roof system allows ambient air to be drawn into the eave vent to circulate through the airflow cavity and out the ridge vent in order to prevent thermal flexing of the metal roof and the build-up of moisture between the metal panels and decking.

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 6, 10, 12 and 16-20 are determined to be patentable as amended.

Claims 2-5, 7, 8, 9, 11 and 13-15, dependent on an amended claim, are determined to be patentable.

1. A metal roof system adapted to allow for ventilation of vapors, comprising:

a sloped roof having a first end and a second end thereof, said roof sloping generally downward from said first end to said second end, said roof having a wooden decking and a metal panel overlaying said decking, said decking [having a] *being* generally planar *across substantially the entire* top surface *thereof*, said metal panel having a generally planar portion thereon;

at least one spacer disposed between said decking and said metal panel, said at least one spacer having one or more openings therein to form an airflow cavity between said decking and said metal panel *that extends from said second end of said roof to said first end of said roof, said roof and* said airflow cavity adapted [for] *to allow* the flow of air *only* between said second end of said roof and said first end of said roof *so as to draw ambient air into said airflow cavity from said second end of said roof and discharge air at said first end of said roof*;

a first fastener attaching said spacer to *said planar top surface of* said decking; and a second fastener attaching *said planar portion of* said metal [panels] *panel* to said spacer.

6. The metal roof system according to claim 1, wherein said metal [panels have] *panel has* a plurality of alternating ribs and valleys, said valleys forming said planar portion of said metal panels.

10. The metal roof system according to claim 1[, wherein said decking is made out of wood] *further comprising a thermal barrier disposed between said spacer and said planar top surface of said decking*.

12. A metal roof system adapted to allow for ventilation of vapors, comprising:

a sloped roof having a first end and a second end thereof, said roof sloping generally downward from said first end to said second end, said roof having a wooden decking and a metal panel overlaying said decking, said decking [having a ] *being* generally planar *across substantially the entire* top surface *thereof*, said metal panel having a generally planar portion thereon;

a plurality of spacers disposed between said decking and said metal panel *with said planar portion of said metal panel attached to said spacer*, each of said spacers having a generally planar top section, a generally planar bottom section and a center section interconnecting said top section and said bottom section, said center section maintaining said top section and said bottom section in a spaced apart relation, one or more openings in said center section of said spacers, said one or more openings forming an airflow cavity between said decking and said metal panel *that extends from said second end of said roof to said first end of said roof, said roof and* said airflow cavity adapted [for] *to allow* the flow of air *only* between said second end of said roof and said first end of said roof *so as to draw ambient air into said airflow cavity from said second end of said roof and discharge air at said first end of said roof*;

a first fastener attaching *said generally planar bottom section of* said spacer to *said planar top surface of* said decking;

a second fastener attaching *said generally planar portion of* said metal [panels] *panel* to *said generally planar top section of* said spacer; and a ridge vent at said first end of said roof, said ridge vent in fluid flow connection with said airflow cavity.

16. The metal roof system according to claim 12[, wherein said decking is made out of wood] *further comprising a thermal barrier disposed between said generally planar bottom section of said spacer and said planar top surface of said decking*.

17. A method of installing a metal roof system adapted to allow for ventilation of vapors on a sloped roof, comprising the steps of:

a) Attaching a wooden decking to a roof support member of a structure*, said decking being generally planar across substantially the entire top surface thereof, said roof sloping generally downward from a first end of said roof to a second end of said roof*;

b) Attaching one or more spacers to *said planar top surface of* said decking, wherein each of said spacers has a generally planar top section, a generally planar bottom section and a center section disposed therebetween, said center section having one or more openings therein; and c) Attaching *a generally planar portion of* a metal panel to said top section of said spacers *to define an airflow cavity between said metal panel and said decking through said openings in said center section of said spacers, said roof and said airflow cavity cooperatively configured to facilitate the flow of air only between said second end of said roof and said first end of said roof so as to allow ambient air to be drawn into said airflow cavity from said second end of said roof and discharge air at said first end of said roof.*

18. The method of claim 17[, wherein said decking is made out of wood] *further comprising a thermal barrier disposed between a generally planar bottom section of said spacer and said planar top surface of said decking*.

19. The method of claim 17 further comprising the step of connecting [said metal panel to] a ridge vent [on] *at said first end of* said roof *to said airflow cavity so as to allow air to be discharged from said airflow cavity through said ridge vent*.

20. The method of claim 19 further comprising the step of connecting [said metal panel to a] *an* eave vent [on] *at said second end of* said roof *to said airflow cavity so as to allow ambient air to be drawn into said airflow cavity through said eave vent*.

* * * * *